US008033318B2

(12) United States Patent
Kapaj et al.

(10) Patent No.: US 8,033,318 B2
(45) Date of Patent: Oct. 11, 2011

(54) PLANT FOR PRODUCING METAL STRIP

(75) Inventors: Nuredin Kapaj, Udine (IT); Alfredo Poloni, Fogliano Redipuglia (IT)

(73) Assignee: Danieli & C. Officine Meccaniche S.p.A., Buttrio (IT)

( * ) Notice: Subject to any disclaimer, the term of this patent is extended or adjusted under 35 U.S.C. 154(b) by 621 days.

(21) Appl. No.: 12/096,552

(22) PCT Filed: Dec. 5, 2006

(86) PCT No.: PCT/EP2006/069327

§ 371 (c)(1),
(2), (4) Date: Jun. 6, 2008

(87) PCT Pub. No.: WO2007/065895

PCT Pub. Date: Jun. 14, 2007

(65) Prior Publication Data

US 2009/0020258 A1 Jan. 22, 2009

(30) Foreign Application Priority Data

Dec. 6, 2005 (IT) ..... MI2005A2328

(51) Int. Cl.
*B22D 11/128* (2006.01)
*B22D 11/14* (2006.01)

(52) U.S. Cl. ..... 164/442; 164/448

(58) Field of Classification Search ..... 164/442, 164/448

See application file for complete search history.

(56) References Cited

U.S. PATENT DOCUMENTS 3,586,094 A * 6/1971 Machida ..... 164/442
3,651,857 A * 3/1972 Koch ..... 164/448
4,227,636 A 10/1980 Rahmfeld et al.
6,467,533 B1 * 10/2002 Murakami et al. ..... 164/484

* cited by examiner

*Primary Examiner* — Jessica L Ward
*Assistant Examiner* — Kevin E Yoon
(74) *Attorney, Agent, or Firm* — Reising Ethington P.C.

(57) ABSTRACT

Plant for the continuous casting of thick slabs, blooms or other similar steel products comprising an ingot mold and a series of containment and guiding rollers placed in the area below the ingot mold on both sides of the cast product, i.e. on the intrados and extrados, respectively. The rollers are arranged on at least three longitudinal rows and all have an axial length shorter that the width of the cast product. The rollers of a central longitudinal row are advantageously staggered with respect to the lateral longitudinal row rollers in such a way as to reduce the surface of the bulges created due to the ferrostatic pressure existing in the liquid core of the product at ingot mold outlet. Furthermore, the pitch between the adjacent rollers is advantageously always of different values so as to not cause the buckling of the bulges with a single frequency.

7 Claims, 3 Drawing Sheets

PLANT FOR PRODUCING METAL STRIP

TECHNICAL FIELD

The present invention relates to a plant for the continuous casting of thick slabs, blooms and other similar products.

BACKGROUND ART

Numerous state of the art plants for the continuous casting of thick slabs and blooms are known. These plants use containment and guiding rollers arranged under the ingot mould to support and accompany along the bend below the product exiting the ingot mould whilst the solidification of all the steel takes place. On exiting the ingot mould the cast product is only partially solidified and is constituted by the solidified external part, known as the skin or shell, with a thickness that grows as the distance from ingot mould outlet increases, and a still liquid part, the so-called core or metal core. The solidification endpoint, i.e. the tip of the metal core, may be more or less distant from the ingot mould outlet section according to the casting speed of the plant. As continuous attempts are made to increase the casting speed in order to increase casting plant productivity, the length of the metal core may sometimes be important.

Due to the presence of liquid steel inside the cast product exited from the ingot mould, ferrostatic pressure exists, which presses from inside towards the exterior and causes the skin to deform in the stretches in which it is not supported by the containment and driving rollers: due to this ferrostatic pressure, bulges form on the surface of the cast product in the areas comprised alternatively between two rows of adjacent rollers. This phenomenon is known as "static bulging".

One problem that originates from the presence of such bulges is that of the surging of the liquid steel upwards due to the buckling of the bulges produced by the rollers during the advance of the thick slab along the rollerway. This pulsation is transmitted to the entire liquid metal column causing a pulsed variation of the meniscus level inside the ingot mould. This phenomenon is known as "dynamic bulging" and is amplified by the increase in casting speed; the meniscus oscillations may be so high as to make control of the ingot mould levels impossible with a consequent necessary interruption of the casting process and production loss. In the worst cases, meniscus oscillations may be such as to cause the liquid steel to leak from the ingot mould.

Another drawback caused by dynamic bulging is that relating to the internal and superficial skin cracks, which form due to the periodical bulging of the skin; these cracks create the presence of defects in the end product and may favour the rupture of the skin with consequent leakage of the liquid steel, a phenomenon known as "breakout".

A casting plant that offers a solution to the drawback is disclosed by U.S. Pat. No. 6,308,769, which describes a casting plant in which a thick slab guiding device is envisaged arranged immediately at the outlet from the ingot mould. The device is constituted by a number of segments that support series of rollers that constitute the thick slab containment guides. The rollers on one side are arranged with their axes staggered with respect to the opposite side of the thick slab; and the pitch of the rollers on both sides always remains constant. This particular arrangement is maintained for a stretch in which a liquid core is present in the thick slab. In any case, the solution offered by this plan is not satisfactory in those cases in which the casting speed is excessively high. In fact, the pulsation due to the passage of the bulges between the rollers continues to occur and is also due to the large volume of the bulges that in any case occur between two adjacent rollers. FIG. 1A, which illustrates a front view of a known casting plant of the type described in U.S. Pat. No. 6,308,769, shows the amplitude of the area interested by the bulging phenomenon between two rollers, distanced at a constant pitch "p", and indicated with the dotted line.

Furthermore, a staggered arrangement of the rollers as envisaged by the above mentioned document does not make it possible to perform "soft-reduction", in order to reduce the thickness of the thick slab on outlet from the ingot mould and to improve the internal quality thereof.

A plant for the continuous casting of metal products that overcomes these drawbacks is therefore required.

SUMMARY OF THE INVENTION

The primary aim of this invention is to make a plant for the continuous casting of metal products, hereinafter generically included under the term of continuous ingot, able to prevent and/or reduce the phenomenon of the pulsation of liquid steel following the passage between the containment rollers, placed beneath the ingot mould, of the skin bulges generated by the ferrostatic pressure.

A second aim of the invention is to limit, as far as possible, skin deformation caused by ferrostatic pressure between two rows of adjacent rollers.

A further aim of the invention is to minimise the above mentioned phenomena of dynamic bulging even at high casting speeds, thus making it possible to increase the productivity of the plant and guaranteeing, at the same time, the obtainment of a better quality final product.

This invention therefore aims at resolving the drawbacks discussed above and to achieve the aforesaid aims by making a plant for the continuous casting of continuous steel ingots, in particular, although not exclusively, in the form of thick slabs, blooms or similar products, comprising a continuous casting ingot mould defining a vertical casting axis and a continuous ingot guiding device arranged under the ingot mould and in which a plurality of rotating rollers is incorporated around its own horizontal rotation axis arranged on two opposite sides of the continuous ingot with respect to the casting axis, having a continuous ingot guiding function, each of said rollers having an axial length less than the length of said opposite sides measured according to a parallel to the rotation axis characterised by the fact that on each of said two opposite sides the rollers are arranged along at least three respective rows parallel to the casting axis so as to create a guide for the ingot, wherein a row of first rollers is positioned in an area in the vicinity of a first corner of the ingot, wherein at least a row of second rollers is positioned in a central area close to the casting axis, wherein a row of third rollers is positioned in an area in the vicinity of a second ingot corner, wherein the rotation axes of the two first adjacent rollers are spaced at a preset distance, wherein the rotation axes of the two second adjacent rollers are spaced at a preset distance from one another, wherein the rotation axes of the two third adjacent rollers are spaced at a preset distance from one another, wherein the rotation axes of the second rollers are spaced with respect to both the rotation axes of the first rollers and with respect to the rotation axes of the third rollers.

The dependent claims describe preferred embodiments of the invention. In one variant, the first distance between axes of adjacent rollers arranged in the rows in the vicinity of the ingot corners has different values along the casting line, and said distance may vary in a regular way or irregular way, in order to favour the damping of the pulsation frequency of the liquid steel column and therefore disturbance at the meniscus.

In another embodiment, the distance between axes of adjacent rollers arranged in the row in correspondence with the centre of the ingot has different values along the casting line, and this distance may be the same as or different from the distance between the rollers arranged in the rows placed in the vicinity of the ingot corners.

In another embodiment of the plant of the present invention, the distances between adjacent rollers of the rows arranged in correspondence with the corners and between adjacent rollers of the rows in the centre of the ingot are different from one another, further increasing the irregularity of roller arrangement along the first stretch of ingot.

In a further embodiment of the invention, the pitch of the rollers of the rows along the corners and/or the pitch of the rollers at the centre of the continuous ingot are different according to whether they are arranged on the intrados or on the extrados of the ingot.

Each of these various combinations of pitch between rollers allows an efficient damping of the oscillation phenomena at the meniscus and contributes to the improvement of the casting process.

One advantage of the plant scope of this invention consists in the fact that the area on which the ferrostatic pressure of the liquid steel acts between adjacent rollers is of a smaller dimension with respect to other state of the art solutions and therefore reduces the entity of bulge area deformation.

The characteristic of introducing pitches of different magnitude between adjacent rollers means that the rollers to not cause the buckling of the bulges with a single frequency and therefore advantageously make it possible to damp the pulsation frequency of the liquid steel column upwards.

Therefore the arrangement of the rollers according to the invention considerably reduces the risk of dynamic bulging phenomena in two ways: by reducing the entity of the bulges and by damping the buckling frequency thereof.

BRIEF DESCRIPTION OF THE FIGURES

Further characteristics and advantages of the invention will become apparent in view of the detailed description of a preferred, though not exclusive, embodiment of a plant for the continuous casting of metal products, given by way of non limiting example by means of the appended drawings wherein.

DETAILED DESCRIPTION OF PREFERRED EMBODIMENTS OF THE INVENTION

Figure 1B:
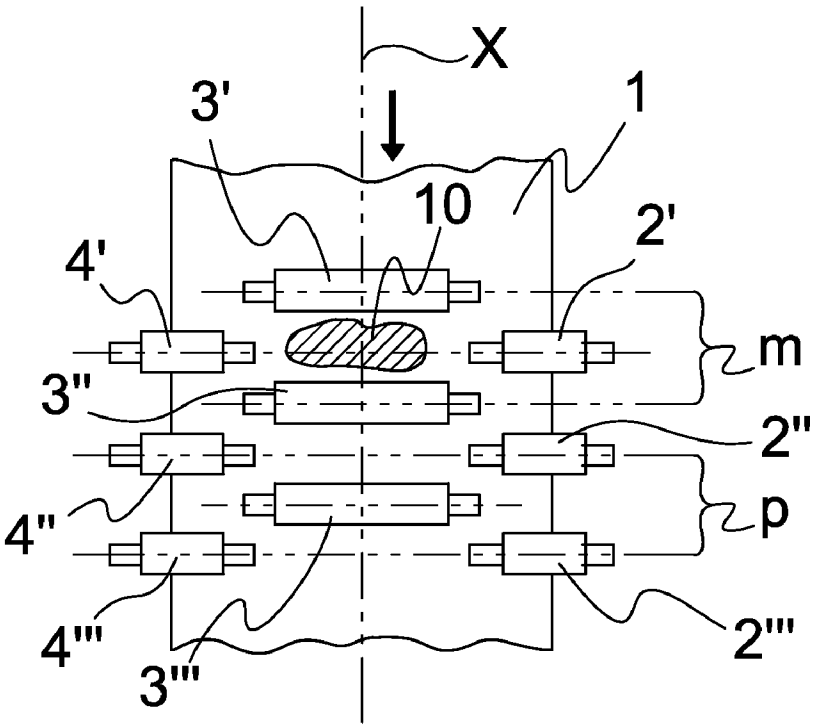
FIG. 1B shows a frontal schematic view of the device conform to the invention.
Figure 1A:
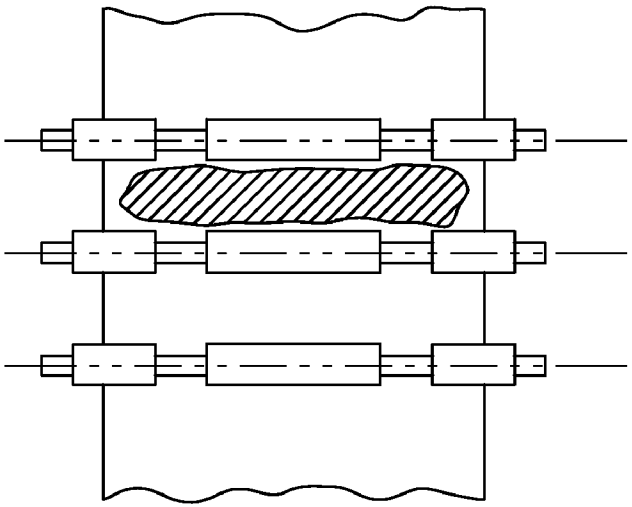
FIG. 1A shows a frontal schematic view of a continuous casting plant of the prior art.

FIG. 1B shows a plant for the continuous casting of a continuous ingot 1, for example in the form of a thick slab, bloom or similar steel product, comprising a series of containment and guiding rollers arranged under the ingot mould, not illustrated in the figure.

For greater explanatory clarity of the invention, the following are defined:

intrados and extrados of the ingot 1 are the surfaces of the ingot that are closer to and farthest from the centre of casting machine bends, respectively;

transverse rows of rollers, are those rows arranged in a substantially orthogonal direction to the casting direction;

longitudinal rows of rollers, are those rows arranged in a substantially parallel direction to the casting direction.

In accordance with the embodiment illustrated in FIG. 1B, three longitudinal rows of rollers can be identified. The two lateral longitudinal rows that contain the ingot in correspondence with the area of the corners comprise, for example, rollers 2', 2", 2'" and 4', 4", 4'"; the central longitudinal row, substantially parallel to the casting axis X of the ingot comprises, for example, the rollers 3', 3", 3'". In accordance with the present invention, the rotation axes of the lateral longitudinal row rollers are staggered with respect to the axes of the central longitudinal row rollers so as to minimise the areas 10 of the ingot surface that are not supported by any roller and on which ferrostatic pressure is exerted.

In this way, skin bulges caused by ferrostatic pressure are smaller and the likelihood of the dynamic bulging phenomenon occurring is reduced.

The axes of the rollers 2', 2" 2'" and those of rollers 4', 4", 4'" are arranged along the longitudinal rows, positioned at the corners of the ingot 1, and are spaced at a constant value pitch "p". The axes of the rollers 3', 3", 3'" arranged along the longitudinal row of the central area of ingot 1 are spaced at a constant pitch "m". In this embodiment the central longitudinal row rollers have a longitudinal extension greater than that of the lateral longitudinal rows in correspondence with the ingot corners. This does not exclude other embodiments wherein this relationship, regarding the longitudinal extension of the rollers, is different.

In another advantageous embodiment, within the scope of the invention, pitches "m" and "p" are defined in such a way as to have a different value between adjacent rollers. The law of variation of pitch between the rollers of the various longitudinal rows may be different or the differences of pitch may not follow any law, being defined only by random pitch variations.

Such measures on the choice of the values of the pitches m and p make it possible to damp the pulsation frequency of the liquid metal column.

In a further advantageous variant, the pitch "m" between the adjacent rollers of the central row and the pitch "p" between the adjacent rollers of the lateral rows are of different values, and both pitch "m" and pitch "p" assume different values according to the pair of adjacent rollers they refer to.

Figure 3:
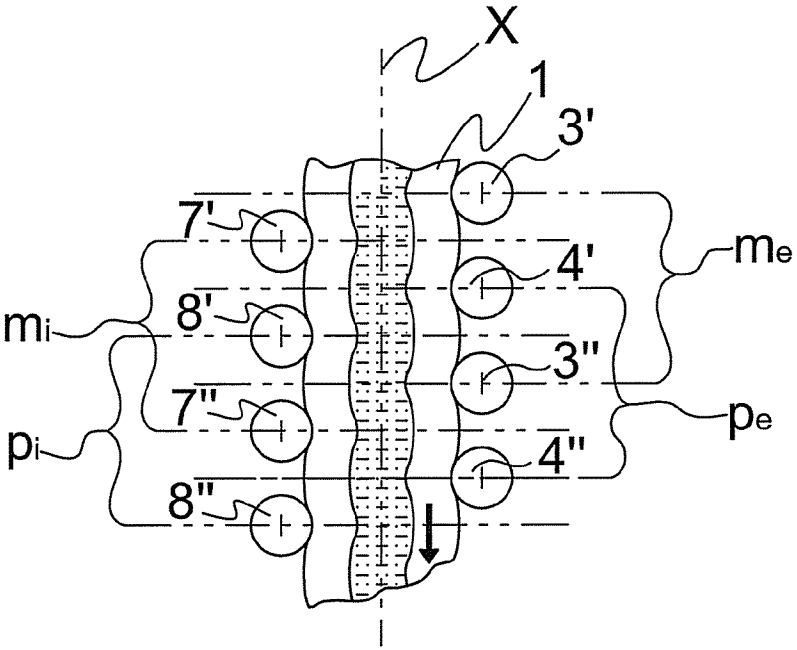
FIG. 3 shows a side view of an embodiment of the device of FIG. 1B.
Figure 2:
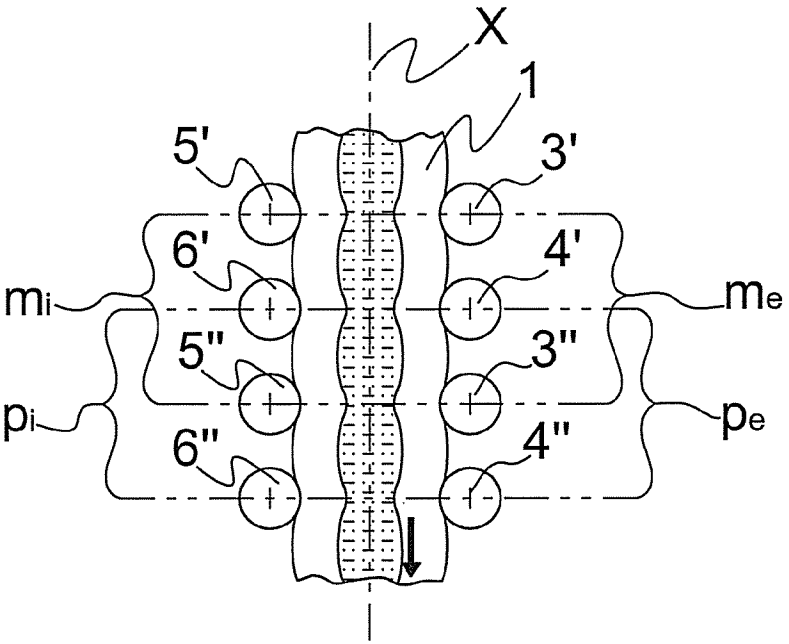
FIG. 2 shows a side view of the device in FIG. 1B.

FIGS. 2 and 3 refer to two embodiments of the invention with different arrangements of the transverse rows of rollers respectively on the intrados and extrados of the ingot 1. The transverse rows of rollers illustrated in said figures may refer indiscriminately to the central longitudinal row or to one of the longitudinal lateral rows of FIG. 1B.

FIG. 2 illustrates a side view of the ingot in which both some intrados rollers and some extrados rollers are visible. In this case, each extrados roller 3', 3" and the corresponding intrados roller 5', 5" of the central longitudinal rows have their respective rotation axes lying on the same plane perpendicular to the ingot casting axis X. The same applies for extrados rollers 4', 4" and the corresponding intrados rollers 6', 6" of the lateral longitudinal rows. More simply, the rollers 5', 5", 6', 6" along the intrados and the corresponding rollers 3', 3", 4', 4" along the extrados are arranged symmetrically with respect to the ingot casting axis.

Therefore in this variant, pitches "$p_e$" and "$m_e$" of the extrados rollers are equal to the pitches "$p_i$" and "$m_i$" of the corresponding intrados roller, respectively. Advantageously, with a roller arrangement conform to this variant it is possible to perform soft-reduction of the ingot by bringing closer together with known mechanisms the intrados rollers and those of the extrados.

FIG. 3, on the other hand, illustrates a side view of the ingot wherein the rollers on the intrados in the different longitudinal rows have rotation axes staggered with respect to the axes of the corresponding rollers on the extrados of the ingot 1. In particular, each extrados roller 3', 3" and the corresponding intrados roller 7', 7" of the central longitudinal rows have their respective rotation axes lying each one on a different plane perpendicular to the ingot casting axis X. The same applies for extrados rollers 4', 4" and the corresponding intrados rollers 8', 8" of the lateral longitudinal rows. In this variant, the pitch values "$p_e$" and "$m_e$" of the extrados rollers may be respectively equal or different from the values of pitches "$p_i$" and "$m_i$" of the corresponding intrados rollers.

In accordance with the variants illustrated in FIGS. 2 and 3, the pitches "p" and "m" may be equal or different to one another, or both pitch "m" and pitch "p" may respectively have different values considering the different pairs of adjacent rollers to which they refer in each longitudinal row.

Figure 5:
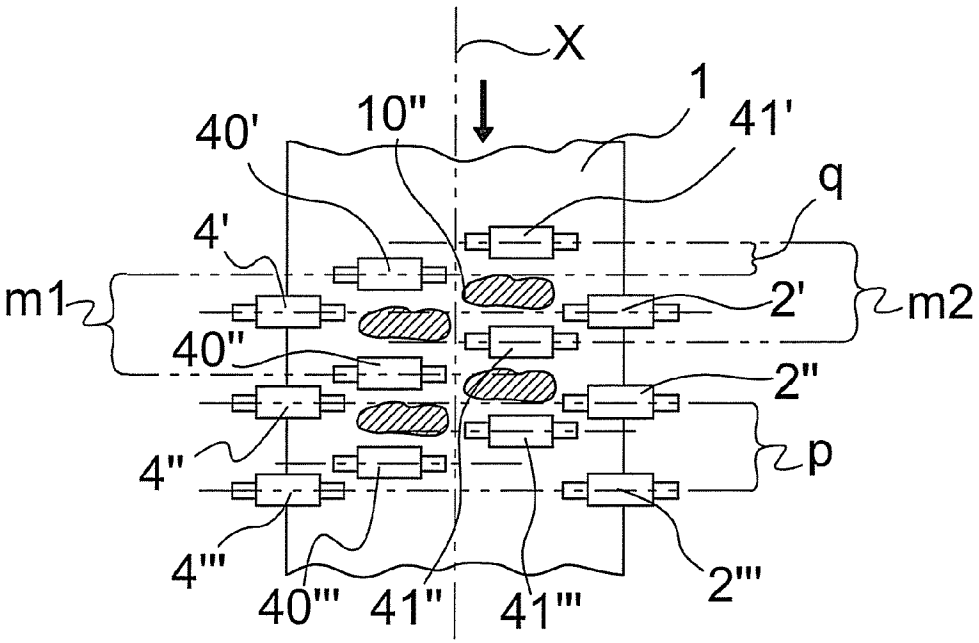
FIG. 5 shows a frontal schematic view of a third embodiment of the device according to the invention.
Figure 4:
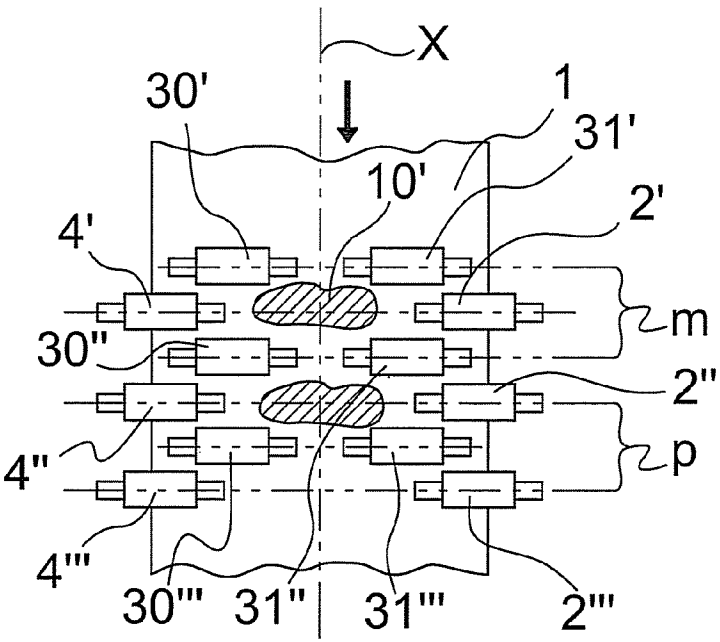
FIG. 4 shows a frontal schematic view of a second embodiment of the device conform to the invention.

Further advantageous embodiments of the invention are illustrated in the schematic front views of FIGS. 4 and 5, in which four longitudinal rows of rollers can be identified.

In FIG. 4, the two lateral longitudinal rows that contain the ingot in correspondence with the area of the corners comprise, for example, rollers 2', 2", 2'" and 4', 4", 4'"; the two central longitudinal rows, which contain the ingot in correspondence with the central part thereof comprise, for example, rollers 30', 30", 30'" and 31', 31", 31'", respectively.

In accordance with this variant, the rotation axes of the rollers of the lateral longitudinal rows are staggered with respect to the axes of the rollers of the central longitudinal rows in such a way as to minimise the areas 10' of the ingot surface that are not supported by any roller and on which ferrostatic pressure is exerted.

The axes of the rollers 2', 2", 2'" and those of rollers 4', 4", 4'" are arranged along the longitudinal rows, positioned at the corners of the ingot 1, and are spaced at a constant value pitch "p". The axes of the rollers 30', 30", 30'" and those of the rollers 31', 31", 31'" arranged along the longitudinal row of the central area of the ingot 1 are spaced at a constant pitch "m".

For each transverse row of rollers there are alternatively two rollers of the central longitudinal rows, for example rollers 30' and 31, having a common rotation axis, and two lateral longitudinal row rollers, for example rollers 4' and 2' also having a common rotation axis.

It is also possible that pitches "m" and "p" are defined so as to be of different value between adjacent rollers. The laws of variation of pitch between the rollers of the various longitudinal rows may be different or the differences of pitch may not follow any law, being defined only by random variations in pitch, to be chosen according to specific casting parameters. Such measures on the choice of the values of the pitches "m" and "p" make it possible to damp the pulsation frequency of the liquid metal column. Furthermore, the pitch "m" between the adjacent rollers of the central row and the pitch "p" between the adjacent rollers of the lateral rows may also be of different values, and both pitch "m" and pitch "p" may assume different values according to the pair of adjacent rollers they refer to.

In the embodiment in FIG. 5, unlike that in FIG. 4, the rollers of the two central longitudinal rows, for example the rollers 40', 40", 40'" and rollers 41', 41", 41'", are respectively staggered to one another.

In accordance with the present embodiment, the rotation axes of the rollers of the lateral longitudinal rows are staggered with respect to the axes of the rollers of the central longitudinal rows in such a way as to further reduce the dimension of the areas 10" of the ingot surface that are not supported by any roller and on which ferrostatic pressure is exerted. In this case, the areas 10" are more numerous but smaller and are staggered to one another as are the rollers of the two central longitudinal rows.

The axes of the rollers 2', 2", 2'" and those of rollers 4', 4", 4'" are arranged along the longitudinal rows, positioned at the edges of the ingot 1, and are spaced at a pitch "p".

The axes of the rollers 40', 40", 40'" arranged along the first central longitudinal row, are spaced at a pitch "m1".

The axes of the rollers 41', 41", 41'", arranged along the second central longitudinal row, are spaced at a pitch "m2".

Each of the axes of the rollers in the first central longitudinal row is staggered with respect to each of the adjacent rollers of the second central longitudinal row at a distance or pitch "q".

Each of the pitches "p", "m1", "m2", "q" may assume a value that is always constant along the casting line or may vary according to the different predefined laws of variation or in a random way.

The particular configuration illustrated in FIG. 5 envisages that "p", "m1" and "m2" have a same constant value and that "q" is equal to "p"/2.

The embodiments of FIGS. 4 and 5 allow a further reduction in the dimension of the skin bulges caused by ferrostatic pressure and, consequently, the likelihood that the dynamic bulging phenomenon may occur.

In both these embodiments the central longitudinal row rollers have a longitudinal extension greater than that of the lateral longitudinal rows in correspondence with the ingot corners. Also for these variants, this does not exclude other embodiments wherein this relationship, regarding the longitudinal extension of the rollers, is different.

As for the embodiment in FIG. 1B, also the embodiments corresponding to FIGS. 4 and 5 may present a different arrangement of the transverse rows of rollers respectively on the intrados and extrados of the ingot 1. The intrados rollers and the corresponding intrados rollers of the central and lateral longitudinal rows may have their respective rotation axes lying on the same plane perpendicular to ingot casting axis X, or the intrados rollers may present the respective axes of rotation staggered by a preset distance with respect to the axes of the corresponding rollers on the extrados along casting axis X.

In the first case, the rollers along the intrados and the corresponding rollers along the extrados are arranged symmetrically with respect to the ingot casting axis X. Therefore in this variant, pitches "$p_e$" and "$m_e$" of the extrados rollers are equal to the pitches "$p_i$" and "$m_i$" of the corresponding intrados roller, respectively. Advantageously, with this roller arrangement it is possible to perform "soft-reduction" of the ingot by bringing closer together with known mechanisms the intrados rollers and those of the extrados. Generally this occurs for the rollers that are located in correspondence with the external edges of the thick slab where at the lower outlet of the crystalliser a skin has already formed with a thickness such as to allow such "soft-reduction" operation.

In the second case, on the other hand, the values of pitches "$p_e$", "$m_e$1", "$m_e$2", "$q_e$" of the extrados rollers may be respectively equal or different from the values of pitches "$p_i$", "$m_i$1", "$m_i$2", "$q_i$" of the corresponding intrados rollers. This second configuration is advantageously used in the thick slab area where "soft-reduction" is no longer necessary.

The invention claimed is:

1. A plant for continuous casting of continuous steel ingots comprising:

a continuous casting ingot mold defining a vertical casting axis (X); and a continuous ingot guiding device arranged under said ingot mold, said continuous ingot guiding device including a plurality of rotating rollers rotatable around a horizontal rotation axis and arranged on two opposite sides of said continuous ingot guiding device with respect to the casting axis (X), having a continuous ingot guiding function, wherein each of said plurality of rollers has an axial length shorter than the length of said opposite sides measured according to a parallel to the rotation axis, wherein said plurality of rollers is arranged in respective rows parallel to the casting axis (X) along each of said two opposite sides so as to create a guide for the continuous steel ingot, wherein a first lateral row of said plurality of rollers is positioned in an area in the vicinity of a first corner of the continuous steel ingot, wherein a second lateral row of said plurality of rollers is positioned in an area in the vicinity of a second ingot corner, each of said plurality of rollers of said first lateral row is arranged with rotation axis aligned with the rotation axis of a corresponding one of said plurality of rollers of said second lateral row, wherein two central rows of said plurality of rollers are positioned in a central area close to the casting axis (X) between said first and second lateral rows, said two central rows arranged such that each of said plurality of rollers in a first central row defines rotational axes staggered from rotational axes defined by each of said plurality of rollers in a second central row, wherein the rotation axes of each of said plurality of rollers in said two central rows are staggered with respect to the rotation axes of each of said plurality of rollers in said first and second lateral rows, wherein the rotation axes of a pair of said plurality of rollers of said first and said second lateral rows are spaced at a first pitch (p, $p_i$, $p_e$) in the direction of the casting axis (X), wherein the rotation axes of a pair of adjacent rollers of said central rows are spaced at a second pitch (m, $m_e$, $m_i$) in the direction of the casting axis (X).

2. A plant according to claim 1, wherein said first pitch (p, $p_i$, $p_e$) and said second pitch (m, $m_i$, $m_e$) are equal to one another.

3. A plant according to claim 2, wherein the two opposite sides of the continuous ingot define an intrados side and an extrados side of the ingot and wherein said first pitch ($p_e$, $p_i$) is different according to whether it is arranged on the intrados or extrados.

4. A plant according to claim 3, wherein said second pitch ($m_e$, $m_i$) is different according to whether it is arranged on the intrados or the extrados.

5. A plant according to claim 1, wherein said first pitch (p, $p_e$, $p_i$) and second pitch (m, $m_i$, $m_e$) are different to one another.

6. A plant according to claim 5, wherein the two opposite sides of the continuous ingot define an intrados side and an extrados side of the ingot and wherein said first pitch ($p_e$, $p_i$) is different according to whether it is arranged on the intrados or extrados.

7. A plant according to claim 6, wherein said second pitch ($m_e$, $m_i$) is different according to whether it is arranged on the intrados or the extrados.

* * * * *